US009613765B2

(12) United States Patent
Koepsell

(10) Patent No.: US 9,613,765 B2
(45) Date of Patent: Apr. 4, 2017

(54) ELECTRIC SWITCH WITH AN ACTUATOR

(71) Applicant: Johnson Electric S.A., Murten (CH)

(72) Inventor: Martin Koepsell, Ennepetal (DE)

(73) Assignee: Johnson Electric S.A., Murten (CH)

( * ) Notice: Subject to any disclaimer, the term of this patent is extended or adjusted under 35 U.S.C. 154(b) by 86 days.

(21) Appl. No.: 14/622,285

(22) Filed: Feb. 13, 2015

(65) Prior Publication Data

US 2015/0235783 A1 Aug. 20, 2015

(30) Foreign Application Priority Data

Feb. 15, 2014 (DE) ..... 10 2014 002 104
May 10, 2014 (DE) ..... 10 2014 006 943

(51) Int. Cl.
*H01H 13/18* (2006.01)
*H01H 3/04* (2006.01)

(52) U.S. Cl.
CPC ..... *H01H 3/04* (2013.01); *H01H 13/186* (2013.01)

(58) Field of Classification Search
CPC ..... H01H 13/186; H01H 3/04
USPC ..... 200/332, 335, 342, 343
See application file for complete search history.

(56) References Cited

U.S. PATENT DOCUMENTS 2,743,331 A 4/1956 Lauder et al.
3,755,642 A * 8/1973 Warner ..... H01H 35/00 200/332

FOREIGN PATENT DOCUMENTS

| | | | |
|---|---|---|---|
| DE | 202006018987 | | 4/2007 |
| EP | 0600634 | | 6/1994 |
| EP | 1585155 | | 10/2005 |
| EP | 2006868 | A2 | 12/2008 |
| GB | 798638 | A | 7/1958 |
| WO | WO2012090521 | A1 | 7/2012 |

* cited by examiner

*Primary Examiner* — Renee S Luebke
*Assistant Examiner* — Ahmed Saeed
(74) *Attorney, Agent, or Firm* — Muncy, Geissler, Olds & Lowe, P.C.

(57) ABSTRACT

An electric switch has a housing with an upper surface through which a actuating plunger extends at a position close to a side surface. The actuating plunger is arranged to operate a switching element disposed inside the housing. An actuating lever is fixed to the side surface adjacent the plunger such that the actuating lever extends over and beyond the upper surface of the housing. A stop for the actuating plunger is arranged inside the housing. With this switch the actuating travel is extended solely in relation to the switch. Furthermore a long over-travel exists following switching, wherein any forces which might occur through improper use in relation to the switch do not cause any damaging effects to the switching element.

9 Claims, 2 Drawing Sheets

ELECTRIC SWITCH WITH AN ACTUATOR

CROSS REFERENCE TO RELATED APPLICATIONS

This non-provisional patent application claims priority under 35 U.S.C. §119(a) from Patent Application No. DE102014002104.1 filed in Germany on Feb. 15, 2014, and from Patent Application No. DE102014006943.5 filed in Germany on May 10, 2014, the entire contents of which are hereby incorporated by reference.

FIELD OF THE INVENTION

This invention relates to an electrical switch and in particular, to an electrical switch having an actuator.

BACKGROUND OF THE INVENTION

The invention relates to an electric switch with a housing comprising an upper surface, an actuating plunger which passed through the housing and an actuating lever mounted on and pivotable or otherwise movable with respect to the housing.

The actuating lever forms an additional actuator. A force for triggering the switch is therefore to be applied, not directly to the actuating plunger, but to the actuating lever. The switching force is transferred to the actuating plunger with the aid of the actuating lever.

Such switches and micro-switches are often provided with additional actuators of this kind. They are used to enlarge the switching travel and to receive forces, which in their direction deviate from the movement direction of the actuating plunger. Lateral pushing actuations are converted into travel in direction of the axis of the actuating element. As a result the switch actuating element is stressed less, the range of possible applications is widened and the lifetime of the switch, as a rule, is increased.

For a force acting upon the end of the additional actuator switching travel is increased by an approximately linear factor in relation to the switch without an additional actuator and the actuating force is correspondingly lower.

There is a desire for an electric switch where the actuating travel is extended in relation solely to the switch, and a long over-travel is present after switching, wherein at the same time any forces which might occur through improper use in relation to the switch do not cause any damaging effects on the switching element inside the switch.

SUMMARY OF THE INVENTION

According to the invention this requirement is met in that the actuating plunger is arranged in the upper surface close to a side surface of the housing, and in that an articulation for the actuating lever is formed at this side surface, wherein the actuating lever extends beyond the upper surface of the housing and in that a stop for the actuating plunger is arranged inside the housing.

The actuating plunger is initially mounted to a side surface. To this end a stable articulation can be formed at the side surface. According to the invention provision is made for the actuating lever to extend over the upper surface of the housing which means that it also extends over the actuating plunger arranged in this upper surface. The actuating plunger is arranged close to the side surface of the housing, on which the actuating lever is mounted. The actuating lever can thus protrude freely above the upper surface of the housing with the larger piece of its extension, whilst a shorter section of its extension is formed between the articulation of the actuating lever and the point at which the actuating lever rests on the actuating plunger.

According to the invention provision is made for the actuating lever to extend beyond the upper surface of the housing. This means that the free sections of the actuating lever are no longer arranged above the upper surface of the housing, but protrude freely. If a switching force is applied to this freely protruding section of the actuating lever, the actuating plunger is moved in a triggering manner with the aid of the actuating lever. Following the switching jump of the internal switching element, the actuating plunger is prevented by the stop arranged in the switch housing from moving any further. Forces of improper use are kept at a distance from the switching element by means of the stop. The blocked actuating plunger represents a firm contact surface for the actuating lever, which then, using this contact surface, can be moved further and in this way permits an additional over-travel. This is particularly advantageous for switching systems with a short switching stroke. The actuating lever is allowed to move further without the switching state of the electric switch changing in any way. If now the lever is moved yet further, the actuating lever can make contact with the upper surface of the housing. The upper surface thus forms a receptacle for the actuating lever thereby preventing any damage to it. The edge of the housing facing away from the articulation of the actuating lever between the upper surface and a side surface functions as a contact point for the actuating lever. If yet more force is applied to the actuating lever, the free end of the actuating lever can be bent over the edge, and in doing so the lever of the actuating lever is shortened due to the new contact point at the edge of the housing. The actuating lever is now able to resist the contacting forces through the application of a higher counterforce.

This configuration according to the invention, with the actuating plunger being assigned to a side surface and the actuating lever being hinged in this side surface and extending beyond the upper surface, permits an effective lessening of the load on the actuating plunger and the actuating lever.

As regards construction, provision may be made according to a first further development of the invention, for the actuating lever to be inserted into a gap arranged in the housing in the area of the side surface. In this way a simple but also secure positioning of the actuating lever is achieved. This can be reinforced, in particular, if the actuating lever comprises at least one barb in the area provided for insertion. Based on this barb the actuating lever is able to closely connect itself with the material of the housing in the area of the gap.

Preferably the actuating lever is configured as a spring of solid but resilient material. By means of the actuating lever any switching forces occurring can be transferred to the actuating plunger, and due to the elasticity of the actuating lever any forces occurring as a result of improper use can be resisted. The spring of the actuating lever may, for example, be constructed of metal.

A next further development of the invention provides for the actuating lever to comprise at least one material weakening in the area facing away from the articulation with regard to the actuating plunger. Based on this material weakening the spring characteristic of the actuating lever is adjustable. By removing more material, the actuating lever's capability to yield to forces occurring in this area, is increased. The material weakening may, for example, be realized by providing lateral indents in the extension of the actuating lever. Due to the indents a steep progressive spring characteristic in the over-travel of the actuating lever is avoided. Solely due to the inventive configuration of the actuating lever the actuating travel for the switching operation is extended in relation to the actuating plunger. Moreover, after the switching point has been reached, an over-travel is present without any forces of improper use, which might occur, causing a damaging effect.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
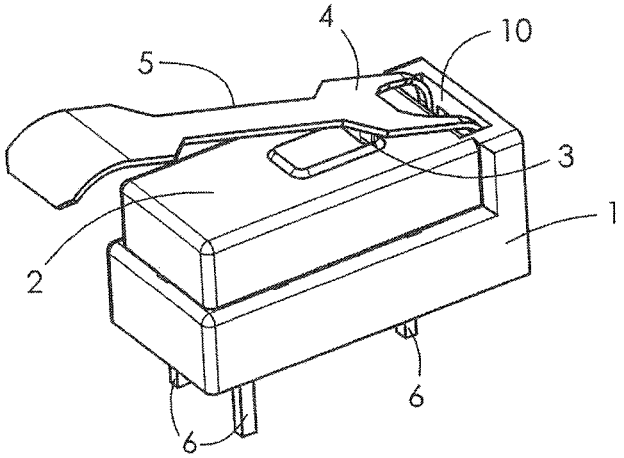
FIG. 1 is a perspective view of an electric switch according to the invention.

The switch of FIG. 1 comprises an approximately rectangular housing 1. The housing 1 has side surfaces and an upper surface 2. An actuating plunger 3 is arranged in the upper surface 2. The actuating plunger 3 is positioned close to one of the side surfaces, and in the area of this side surface an actuating lever 4 is attached to the housing 1. The actuating lever 4 extends above, over and beyond the upper surface 2 of the housing 1. In an area between the point of contact of the actuating lever 4 with the actuating plunger 3 and the free end of the actuating lever 4, the actuating lever 4 comprises indents 5, forming a narrowed and thus more flexible portion of the lever. Contacts 6 protrude from the underside of the switch.

Preferably, the actuating lever is a strip of resilient metal that is pre-shaped and mounted to the housing by being inserted in a gap 10 in the side of the housing. It has a bend in a portion corresponding to an edge between the said side and the upper surface of the housing. This bend creates an articulation point or hinge about which the actuating lever moves or pivots under normal operating conditions.

The switch is shown with three contacts 6, common, upper and lower, extending through the bottom of the housing and forming a common terminal, a normally closed terminal and a normally open terminal, respectively.

Figure 2:
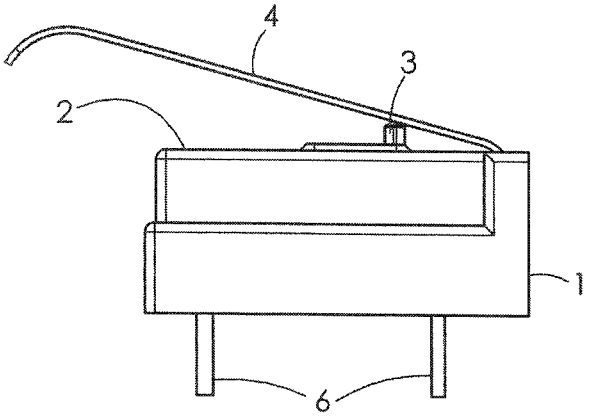
FIG. 2 is a side view of the switch of FIG. 1.
Figure 3:
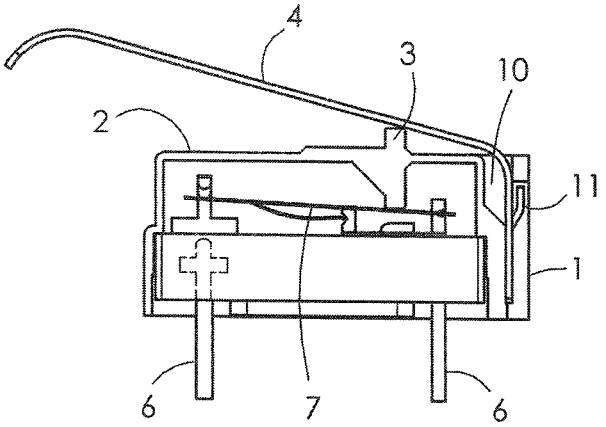
FIGS. 3 to 6 are sectional views of the switch of FIG. 1, in different switching positions.

FIG. 2 shows the actuating lever 4 resting on the actuating plunger 3. This rest position of the switch is also shown in FIG. 3. A spring switching element 7 arranged inside the housing 1 is supported against the upper contact 6.

Figure 4:
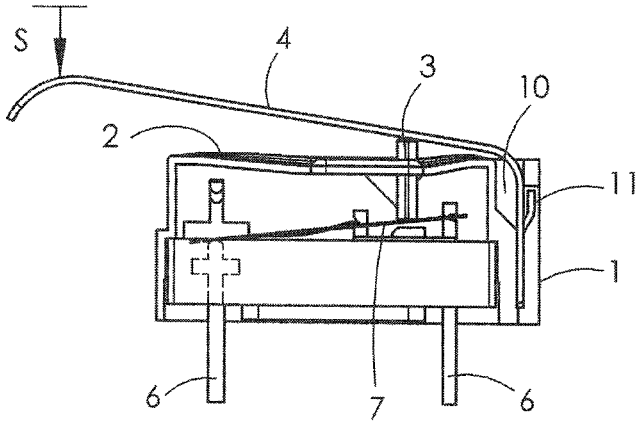

In FIG. 4 the actuating lever 4 has been moved downward by an extent indicated by arrow S, this movement was transferred to the actuating plunger 3, whereupon the spring switching element 7 has detached itself from the upper contact 6 and changed into another switching state, optionally in contact with the lower contact 6. The upper surface 2 of the housing 1 has become slightly indented.

Figure 5:
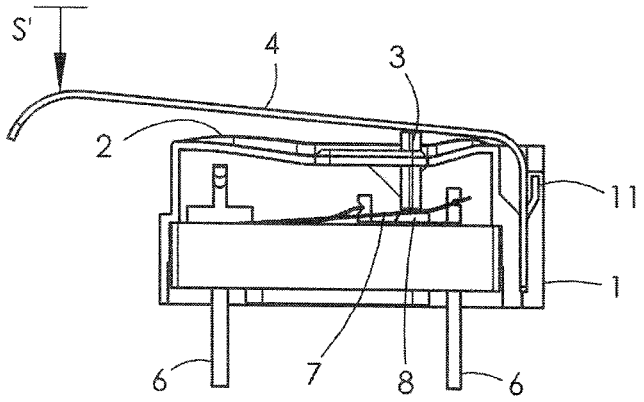

In FIG. 5 the actuating lever 4 has been moved by a greater extent as indicated by arrow S'. Thereupon the actuating plunger 3 was moved towards a stop 8 arranged inside the housing 1. The stop 8 limits the possible movement of the actuating plunger 3 in such a way as to prevent damage to the spring switching element 7 and contacts 6. The upper surface 2 of the housing 1 has become somewhat more indented than shown in FIG. 4.

Figure 6:
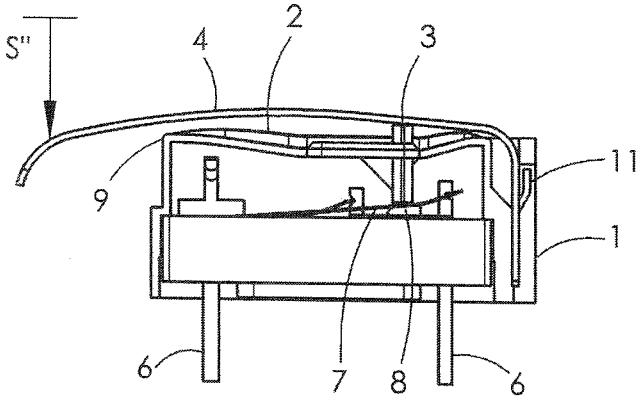

FIG. 6 shows an over-stroke or possible over-travel of the actuating lever 4 due to the impact of even greater forces indicated by arrow S". The actuating lever 4 is nearly touching the edge 9 of the housing 1 formed by the upper surface 2 and a side wall. The upper surface 2 is still indented, and the actuating plunger 3 is still resting on the stop 8. If the actuating lever 4 is moved still further along arrow S" the actuating lever 4 will come to rest on the edge 9. Then the point of leverage for the actuating lever 4 will shift its position. In FIGS. 3 and 4 this point of leverage is the first corner of the housing adjacent to the attachment of the actuating lever. In FIGS. 5 to 6 this point of leverage lies on the actuating plunger 3, for a further movement of the actuating lever 4 the point of leverage will shift again to the edge 9. This causes the effective length of the actuating lever 4 to be shortened, in any case on the portion of the actuating lever 4, which can still be acted upon by the force S". The shorter actuating lever 4 can now oppose the force S" with a greater force.

In order to ensure that the actuating lever 4 is connected securely with the housing 1, the actuating lever 4 is inserted into the gap 10 of the housing 1, the actuating lever 4 additionally comprises a barb 11 to prevent accidental removal of the actuating lever 4 from the gap 10.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that various features of the invention which are, for brevity, described in the context of a single embodiment, may also be provided separately or in any suitable sub-combination.

The embodiment described above is provided by way of example only, and various other modifications will be apparent to persons skilled in the field without departing from the scope of the invention as defined by the appended claims.

The invention claimed is:

1. An electric switch with a housing comprising an upper surface through which a actuating plunger extends and an actuating lever fixed to the housing and arranged to operate the actuating plunger, wherein the actuating plunger is disposed adjacent a side surface of the housing and in that the actuating lever is fixed to said side surface, wherein the actuating lever extends across and beyond the upper surface of the housing and that a stop for the actuating plunger is arranged inside the housing, and wherein the upper surface of the housing is deformable when the actuating lever is forced by an external force to move downwardly and depress the actuating plunger.

2. The switch of claim 1, wherein the actuating lever is inserted into a gap arranged in the housing in an area of said side surface.

3. The switch of claim 2, wherein the actuating lever comprises at least one barb in the area provided for insertion into the gap.

4. The switch of claim 1, wherein the actuating lever is configured as a spring made of a resilient material.

5. The switch of claim 4, wherein the spring of the actuating lever is manufactured of metal.

6. The switch of claim 1, wherein the actuating lever comprises at least one material weakening in an area extending away from its articulation with regard to the actuating plunger.

7. The switch of claim 6, wherein the material weakening is formed by lateral indents in the extension of the actuating lever.

8. The switch of claim 1, wherein a spring switching element is arranged between the actuating plunger and the stop inside the housing.

9. The switch of claim 2, wherein the actuating lever has a bend in a portion corresponding to an edge between the said side surface and the upper surface of the housing, a portion of the bend is disposed within the gap, and a remaining portion of the bend is outside of the gap.

* * * * *